US007367569B2

(12) United States Patent
Viitamaki

(10) Patent No.: US 7,367,569 B2
(45) Date of Patent: May 6, 2008

(54) ROLL SLIDING DEVICE

(76) Inventor: Tapio Viitamaki, Lipastinkuja 12, FI-61330 Koskenkorva (FI)

( * ) Notice: Subject to any disclaimer, the term of this patent is extended or adjusted under 35 U.S.C. 154(b) by 0 days.

(21) Appl. No.: 11/660,157

(22) PCT Filed: Aug. 18, 2005

(86) PCT No.: PCT/FI2005/050294

§ 371 (c)(1),
(2), (4) Date: Feb. 20, 2007

(87) PCT Pub. No.: WO2006/018483

PCT Pub. Date: Feb. 23, 2006

(65) Prior Publication Data

US 2007/0262541 A1 Nov. 15, 2007

(30) Foreign Application Priority Data

Aug. 19, 2004 (FI) ..... 20045303

(51) Int. Cl.
*A63C 17/14* (2006.01)

(52) U.S. Cl. ..... 280/11.2; 280/11.22; 280/11.28; 280/11.27; 280/11.19; 280/87.04

(58) Field of Classification Search ..... 280/11.2, 280/11.22, 11.28, 11.27, 11.19, 87.04
See application file for complete search history.

(56) References Cited

U.S. PATENT DOCUMENTS 4,272,090 A * 6/1981 Wheat ..... 280/11.231
5,342,071 A * 8/1994 Soo ..... 280/11.207
5,630,596 A * 5/1997 Rudolph ..... 280/11.214

FOREIGN PATENT DOCUMENTS

| | | | |
|---|---|---|---|
| DE | 193653 | | 12/1907 |
| DE | 480 663 | | 8/1929 |
| DE | 200 09 179 U1 | | 9/2000 |
| DE | 103 27 970 A1 | | 1/2005 |
| DE | 10327970 | * | 1/2005 |
| GB | 2 334 494 A | | 8/1999 |
| WO | WO 92/22455 | | 12/1992 |
| WO | WO 9222455 | * | 12/1992 |
| WO | WO 01/79027 A2 | | 10/2001 |

* cited by examiner

*Primary Examiner*—Christopher P. Ellis
*Assistant Examiner*—Cynthia F. Collado
(74) *Attorney, Agent, or Firm*—Oliff & Berridge, PLC

(57) ABSTRACT

The invention relates to a roll sliding device comprising a frame, wheels mounted thereon and a shoe or the like for the user's foot, whereby the shoe or the like is pivotably mounted on the frame in relation to a pivoting axle placed in parallel with the axles of the wheels, and a driving arrangement is provided between the shoe and at least one wheel that is arranged to rotate said wheel with the user's forward turning foot movement around the pivoting axle.

4 Claims, 3 Drawing Sheets

ROLL SLIDING DEVICE

BACKGROUND OF THE INVENTION

The invention relates to a roll sliding device comprising a frame, wheels mounted thereon and a shoe or the like for the user's foot, whereby the shoe or the like is pivotably mounted on the frame in relation to a pivoting axle placed in parallel with the axles of the wheels, and a driving arrangement is provided between the shoe and at least one wheel that is arranged to rotate said wheel with the user's forward turning foot movement around the pivoting axle. In this context the roll sliding device refers to a device driven by the user himself/herself, such as roller skates, roller skis or the like, whereby a separate device is required for both feet.

Roller skates and similar products have been known for long and have also been very popular means for various purposes including moving fast at the user's own pace, or for sports, training and entertaining.

Some users desire more speed or wish to proceed more efficiently, and some have therefore started to use for instance poles together with roller skates in a similar way as with skis. This is of course very efficient from a training perspective, but if the user wishes to move even faster and possibly with less effort, there are no means to enable such a fast movement. The strength and normal movements of the user's feet have not been fully utilized, which for instance considering a bicycle has been very successful.

BRIEF DESCRIPTION OF THE INVENTION

It is an object of the invention to eliminate the disadvantage described above and to provide such a moving device, in which the previously unused energy of the user is utilized in a completely new fashion.

The object set is achieved using a roll sliding device according to the invention, which is characterized in that the driving arrangement comprises a planetary gear system, which at the primary side thereof is connected to the shoe and to the rotatable wheel at the secondary side, the primary side of the planetary gear system is composed of an outer casing provided at the inner circumference thereof with a sunwheel tooth rim and at the outer side thereof with means for providing a connection with the shoe, and the secondary side of the planetary gear system comprises a centrally positioned power wheel used by planetary wheels, an output axle connected thereto, a freewheel bearing arranged on the output axle and a pulling wheel mounted on top of the freewheel bearing for providing a connection with the rotatable wheel.

The idea of the invention is to utilize normal human foot movements and body weight. Human body weight provides the main propulsive force by means of the pivotable shoe, but the use thereof does not feel physically heavy.

Even a small transmission ratio is distinctively more preferable in favour of the device according to the present invention compared for instance with a conventional roller skate, which enables to proceed merely by kicking and also to slide backwards. Solely the transmission ratio "1:1" is more efficient than for instance the prevention of sliding backwards with the rolls when kicking. A particularly preferable implementation of the invention is achieved when an adequately high transmission ratio is used when the pivotable movement of the foot is changed to a movement that rotates the drive wheel, and what could be considered in such a case is a planetary gear system in particular, which is connected between the shoe and the rotatable wheel. The planetary gear system enables to implement high transmission ratios within a very small space. Thus, the whole driving arrangement is made very compact, whereby the roll sliding device according to the invention does not in view of the physical space requirements thereof deviate from for instance an ordinary roller skate, if not for instance the length thereof is to be increased in respect of increased speeds and the control of the device.

The roll sliding device according to the invention offers a completely new way of moving that is suitable both for leisure and practical use.

BRIEF DESCRIPTION OF THE DRAWINGS

In the following the invention will be described in greater detail by means of one preferable embodiment with reference to the accompanying drawings, in which.

DETAILED DESCRIPTION OF THE INVENTION

Figure 1:
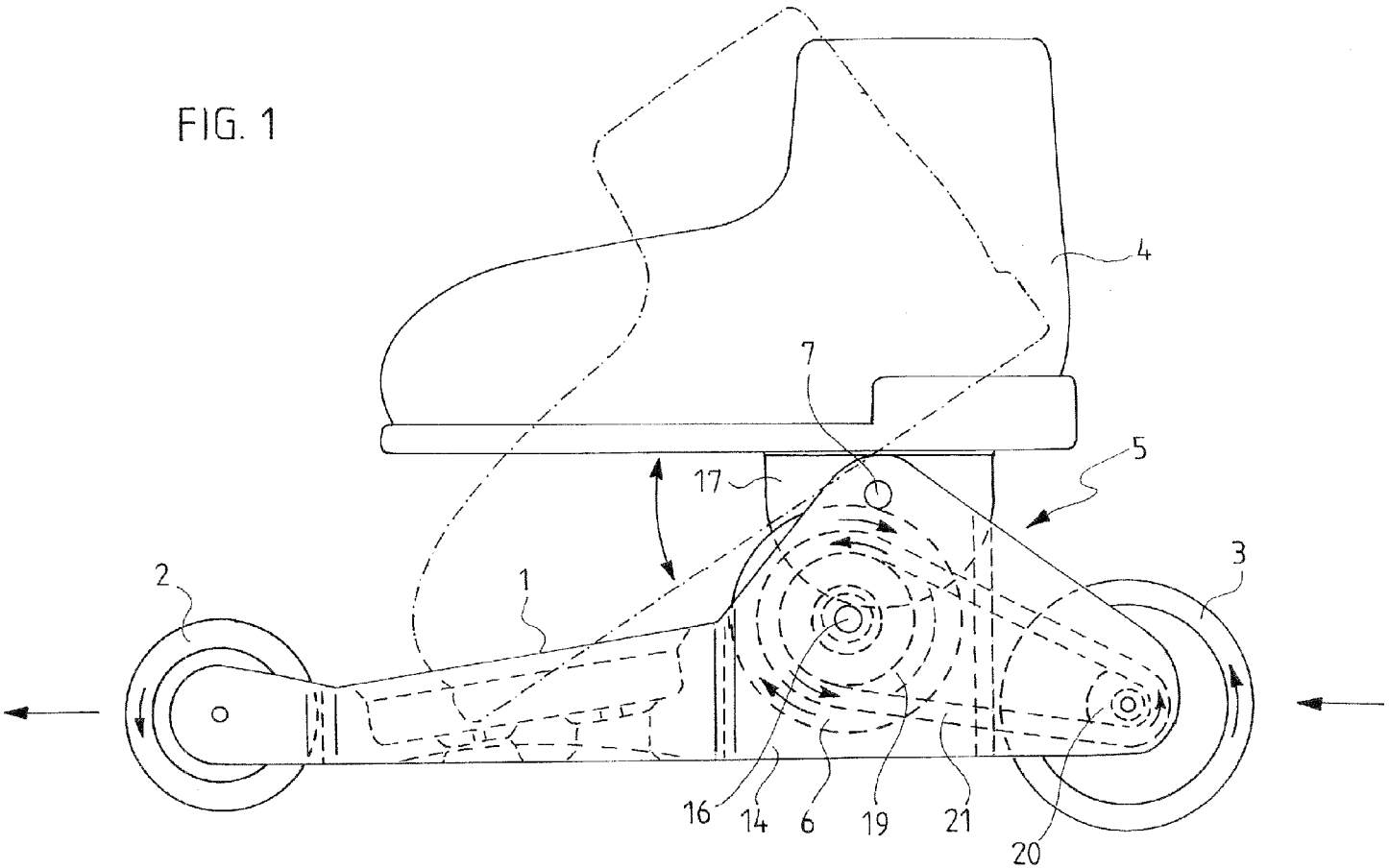
FIG. 1 shows a side view of a roll sliding device.
Figure 2:
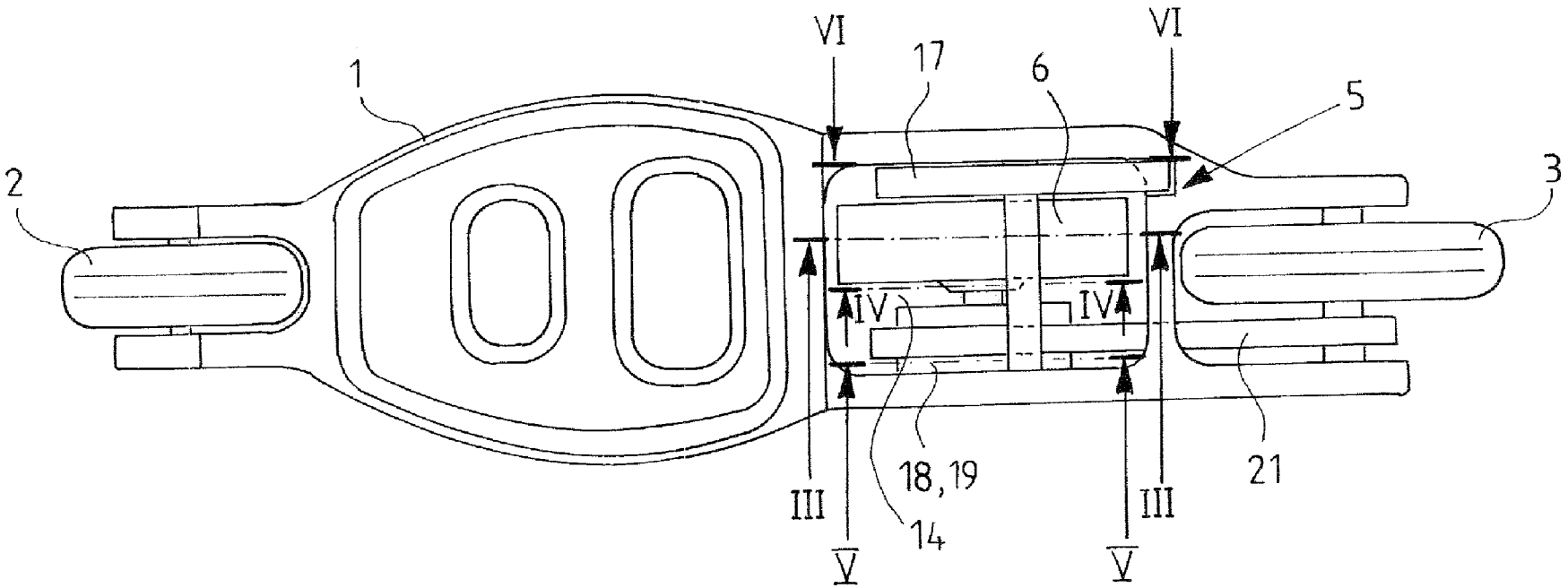
FIG. 2 shows a top view of the roll sliding device but with the shoe removed.
Figure 6:
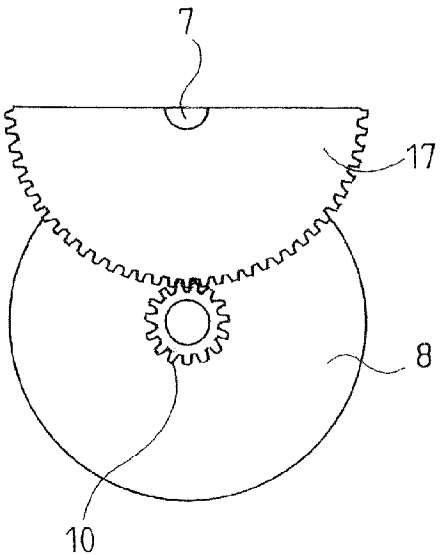
FIG. 6 shows the driving arrangement shown in FIGS. 1 and 2 along line VI-VI.
Figure 4:
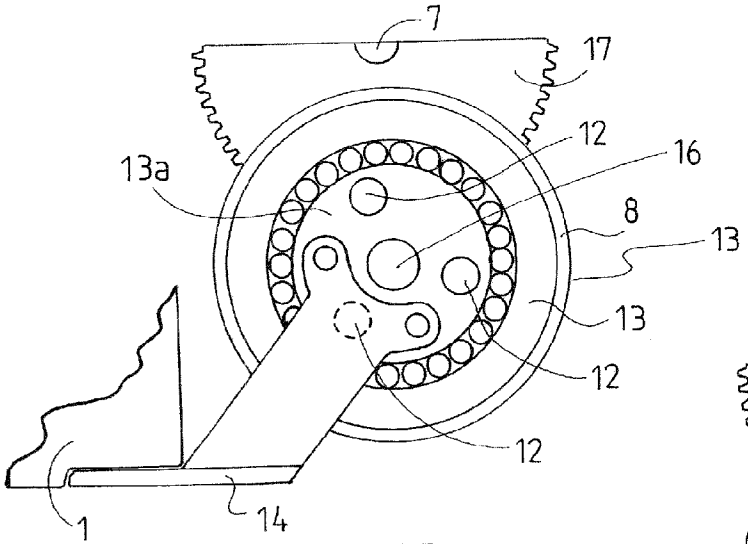
FIG. 4 shows the driving arrangement shown in FIGS. 1 and 2 along line IV-IV.
Figure 5:
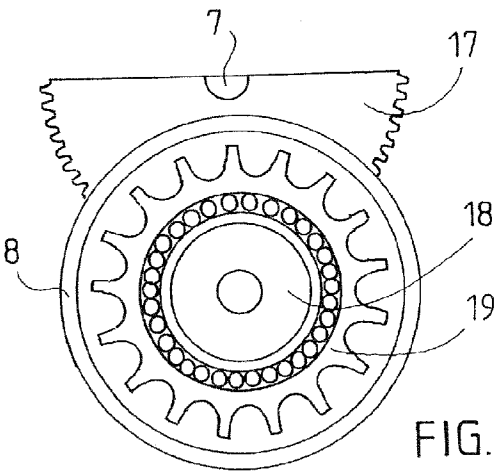
FIG. 5 shows the driving arrangement shown in FIGS. 1 and 2 along line V-V.
Figure 3:
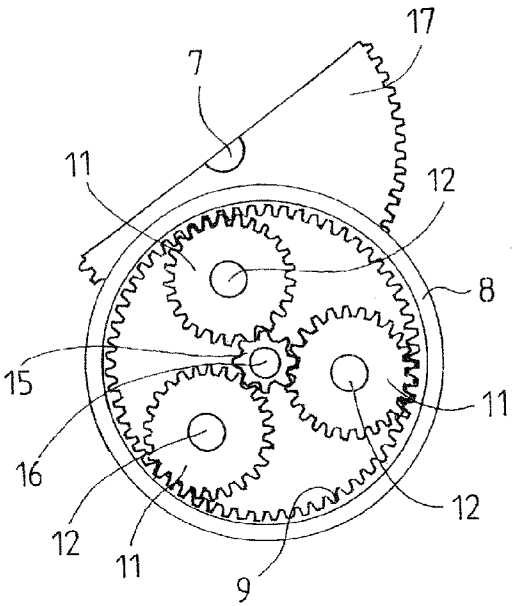
FIG. 3 shows a driving arrangement shown in FIGS. 1 and 2 in cross-cut III-III.

With reference to FIGS. 1 and 2, a roll sliding device according to the invention comprises a frame 1, wheels 2 and 3 mounted on the front and back end of the frame 1, a shoe 4 fastened to the upper part of the frame 1, a shoe support or similar means or space for the foot of the user of the roll sliding device, and a driving arrangement 5 arranged on the frame 1 below the shoe 4.

The frame 1 can be made for instance of steel, light metal, plastic, composite material etc. and the frame can be provided in desired shape and length. The frame may be bilobed, split in relation to the longitudinal middle vertical plane, in which case assembling and disassembling the device is easy and fast.

The size and number of the wheels 2 and 3 may vary and several wheels may be placed successively, in parallel etc.

The shoe 4 can be made such that it is detachable from the driving arrangement 5 or merely a shoe support can be arranged, in which the user fastens his/her own shoe. The shoe 4 can be arranged to be adjustable also in the longitudinal position thereof.

The driving arrangement 5 most appropriately comprises a planetary gear system 6, which at the primary side thereof is connected to the shoe 4 and at the secondary side thereof to the rotatable wheel, in other words to the rear wheel 3 of the device in this example. Other power transmission arrangements are also possible, but if a high transmission ratio is desired then the planetary gear system is able to eliminate a number of pinions and pinion axles of a conventional gear system, at the same time as the arrangement fits into a small space.

The shoe 4 is pivotably mounted on the frame 1 in relation to the pivoting axle 7 in the direction of the axles of the wheels 2 and 3 so that the shoe rotates the rear wheel 3 by means of the planetary gear system 6 with the user's forward turning foot movement around the pivoting axle 7.

In accordance with FIGS. 3 to 6 the planetary gear system 6 is provided with a rotating outer casing 8, where the inner circumference thereof comprises a sunwheel tooth rim 9 and a cog-wheel 10 on one outer side. This assembly can be referred to as the primary side of the planetary gear system. Several planetary wheels 11 (3 in this case), whose axles 12 are supported on a non-rotatable frame part 13*a* of a supporting bearing 13 in the planetary gear system, are arranged inside the casing 8 and connected to the tooth rim 9. The non-rotatability is implemented with a support 14 between the frame 1 of the roll sliding device and the frame part 13*a*. The outer casing 8 is in turn fastened to a rotating outer circumference 13*b* of the supporting bearing 13. The planetary wheels 11 rotate a power wheel 15 arranged in the middle thereof that is provided with an output axle 16, which projects from one side of the supporting bearing 13. This side may be referred to as the secondary side of the planetary gear system.

The shoe 4 is connected to the cogwheel 10 at the primary side of the planetary gear system by means of a driving wheel 17 arranged around the pivoting axle 7, which is fastened to the sole of the shoe 4. The output axle 16 of the planetary gear system 6 is in turn provided with a freewheel bearing 18 and a pulling wheel 19 on top thereof. The pulling wheel 19 is connected to a pulling wheel 20 of the rear wheel 3 in the roll sliding device with a chain, a toothed belt or a V-belt 21. The pulling wheel 19 is locked with the freewheel bearing 18 when a force that rotates the rear wheel 3 forward is conveyed to the freewheel bearing 18 and the pulling wheel 19 by means of the output axle 16, but in the other rotating direction the pulling wheel 19 and the freewheel bearing 18 may rotate freely in relation to one another. Alternatively such a freewheel arrangement can be implemented in connection with the pulling wheel 20 of the rear wheel 3.

As shown above the shoe 4 can also be connected to the primary side of the gear system differently, for instance by means of a lever arm. Correspondingly the secondary pull can also be entirely carried out using cogwheels, an axle etc.

The transmission ratio is selected in such a manner that it represents a good compromise between an easy start and a sufficient maximum speed. The structure also enables to easily change the transmission ratios afterwards. If the transmission ratio is selected to be high it becomes harder to achieve a pulling motion at the start with the pivotable movement of the foot, but once in motion greater speeds are possible. An easier start then again restricts the highest achievable speed.

What can be used as the brake of the roll sliding device is a brake pad (not shown) mounted on the shoe 4, which touches the ground, the rear wheel 3 or the pulling wheel 19 when the shoe 4 is turned backwards. Braking can therefore be compared to braking with roller skates.

The function and use of the roll sliding device is in its simplicity explained in the following.

When the shoe 4 is stationary, for instance placed in parallel with the surface of use, the device rolls freely. When the shoe is turned forward as a result of walking, skating or weight shift of the body, the driving wheel 17 rotates at the same time and rotates the cogwheel 10 at the primary side of the planetary gear system 6. The cogwheel 10 rotates the outer casing of the gear system 6 and thus also the sunwheel tooth rim 9 in the opposite direction in respect of the rotation of the driving wheel 17. The sunwheel tooth rim 9 in turn rotates the planetary wheels 11 in its direction, which in turn rotate the power wheel 15 in the opposite direction. The axle 16 of the power wheel 15 conveys the rotating motion to the pulling wheel 19 by means of the freewheel bearing 18 and forwards from there to the rear wheel 3. Breaking is carried out as shown in the previous section.

The specification of the above invention is merely intended to illustrate the basic idea of the invention as previously mentioned. Those skilled in the art may therefore carry out the details of the invention in various ways without deviating from the limits defined in the accompanying claims. What is actually essential is that the pivotable movement of the foot connected to the device is changed to a power rotating, or driving, one of the wheels.

The invention claimed is:

1. A roll sliding device comprising a frame, wheels mounted thereon and a shoe for the user's foot, whereby the shoe is pivotably mounted on the frame in relation to a pivoting axle placed in parallel with the axles of the wheels, and a driving arrangement is provided between the shoe and at least one wheel that is arranged to rotate said wheel with the user's forward turning foot movement around the pivoting axle, wherein the driving arrangement comprises a planetary gear system, which at the primary side thereof is connected to the shoe and to the rotatable wheel at the secondary side the primary side of the planetary gear system is composed of an outer casing provided at the inner circumference thereof with a sunwheel tooth rim and at the outer side thereof with means for providing a connection with the shoe, and the secondary side of the planetary gear system comprises a centrally positioned power wheel used by planetary wheels, an output axle connected thereto, a freewheel bearing arranged on the output axle and a pulling wheel mounted on top of the freewheel bearing for providing a connection with the rotatable wheel, and the shoe is connected to the primary side of the planetary gear system by means of a cogwheel arranged around the pivoting axle.

2. A roll sliding device as claimed in claim 1, wherein the rotatable wheel is connected to the secondary side of the planetary gear system by means of chain traction.

3. A roll sliding device as claimed in claim 1, wherein the rotatable wheel is connected to the secondary side of the planetary gear system by means of cogged belt pull.

4. A roll sliding device as claimed in claim 1, wherein the rotatable wheel is connected to the secondary side of the planetary gear system by means of an intermediate wheel or intermediate wheels.

* * * * *